United States Patent [19]

Bertsch et al.

[11] Patent Number: 4,552,187

[45] Date of Patent: Nov. 12, 1985

[54] WEAVING MACHINE

[75] Inventors: Gotthilf Bertsch, Rüti; Josef Braun, Seuzach, both of Switzerland

[73] Assignee: Maschinenfabrik Sulzer-Rüti AG, Rüti, Switzerland

[21] Appl. No.: 691,384

[22] Filed: Jan. 14, 1985

[30] Foreign Application Priority Data

Jan. 23, 1984 [EP] European Pat. Off. ..... 84810038.4

[51] Int. Cl.[4] ..... D03D 47/48

[52] U.S. Cl. ..... 139/434; 139/194

[58] Field of Search ..... 139/194, 429, 434, 435

[56] References Cited

U.S. PATENT DOCUMENTS

| | | | |
|---|---|---|---|
| 3,340,902 | 9/1967 | Berry | 139/434 |
| 3,685,551 | 8/1972 | Parshin | 139/434 |
| 4,465,110 | 8/1984 | Dekker | 139/194 |

FOREIGN PATENT DOCUMENTS

| | | | |
|---|---|---|---|
| 2141808 | 1/1973 | France | 139/434 |

*Primary Examiner*—Henry S. Jaudon

*Attorney, Agent, or Firm*—Werner W. Kleeman

[57] ABSTRACT

A retention nozzle is provided at the catch side of the weaving machine for clamping or retaining the weft thread end during severance of the weft thread by means of a shear. A transfer nozzle is also provided at the catch side. When the weft thread lies over the transfer nozzle after being severed, the transfer nozzle is supplied with blower air and subsequently the supply of blower air to the retention nozzle is interrupted. In this manner the weft thread end is withdrawn from a catch channel of the retention nozzle and blown into a catch channel of the transfer nozzle. During this operation, the weft thread end is conducted through an eyelet of a selvedge-laying needle and thereby transferred to the latter. The retention nozzle permits severance of the weft thread by means of the shear even before the weft thread is in alignment with the eyelet of the selvedge-laying needle and the transfer nozzle.

12 Claims, 10 Drawing Figures

Fig.6
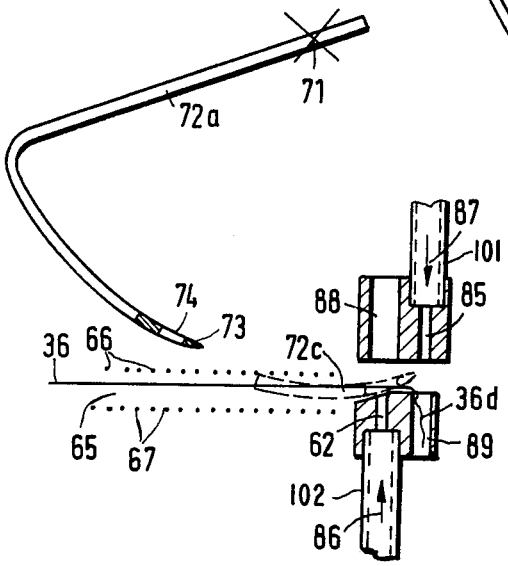
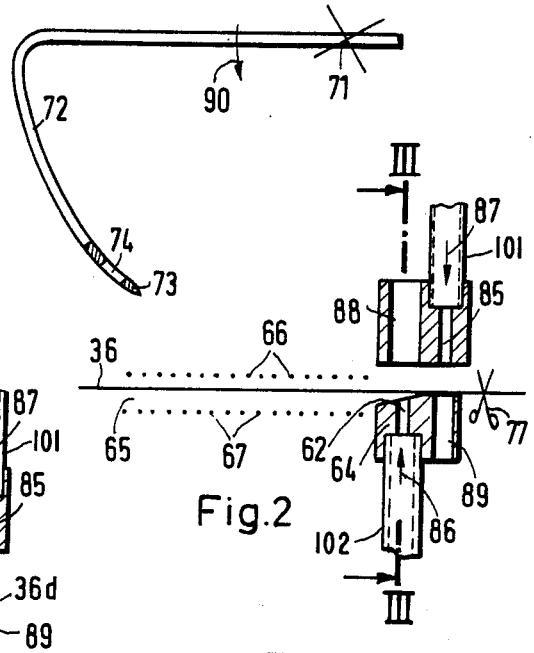
Fig.2
Fig.9
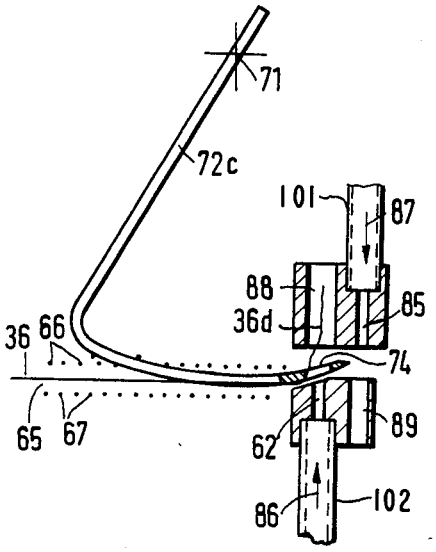
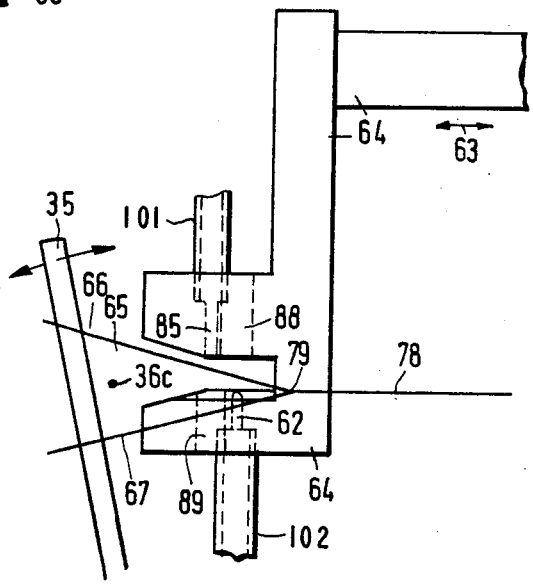
Fig.3

WEAVING MACHINE

CROSS REFERENCE TO RELATED APPLICATION

This application is related to the commonly assigned, copending U.S. application Ser. No. 06/642,542, filed Aug. 20, 1984 and entitled: "Weaving Machine".

BACKGROUND OF THE INVENTION

The present invention broadly relates to weaving machines and, more specifically, pertains to a new and improved construction of a weaving machine having a weft thread supply roll or cone which remains outside the weaving shed during weft insertion and from which weft thread is unwound during weft insertion, a selvedge-laying or tucking in needle for laying or tucking in ends of the weft thread which lie outside the weaving shed into a subsequently formed weaving shed and a jet or air nozzle for transferring the ends of the weft thread to the selvedge-laying or tucking-in needle.

In a known weaving machine of this type (cf. European Patent Application Ser. No. 83 810,397.6 and the aforementioned cognate U.S. patent application Ser. No. 06/642,542, filed Aug. 20, 1984), a thread guide oscillatingly translatable in the warp direction is provided together with a transfer or threading nozzle at the edge or selvedge of the fabric being woven. The weft thread end clamped by the warp threads at the edge or selvedge region of the fabric being woven is conducted through this thread guide and maintained under tension in this position. Then the transfer or threading nozzle is supplied with blower air. The weft thread end can only subsequently be severed by a shear device and transferred to the selvedge-laying needle.

This weaving machine exhibits the disadvantage that the time at which other operations of the weaving machine related to the fabric edge or selvedge can take place depends upon whether the weft thread is already aligned with the transfer or threading nozzle and whether the transfer or threading nozzle is in operation.

SUMMARY OF THE INVENTION

Therefore, with the foregoing in mind, it is a primary object of the present invention to provide a new and improved construction of a weaving machine which does not exhibit the aforementioned drawbacks and shortcomings of the prior art constructions.

Another and more specific object of the present invention aims at providing a new and improved construction of a weaving machine of the previously mentioned type wherein a retention nozzle ensures that the required operations on the fabric edge or selvedge, such as for instance the severance of the weft thread, can be performed independently of whether the weft thread and the selvedge-laying or tucking in needle already in alignment with the transfer or threading nozzle.

Yet a further significant object of the present invention aims at providing a new and improved construction of a wearing machine of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the weaving machine of the present invention is manifested by the features that it comprises a retention nozzle acting upon the weft thread before operation of the transfer or threading nozzle for clamping or retaining the weft thread end before transferring it to the selvedge-laying or tucking-in needle.

Thus, the retention nozzle can ensure that the requisite operations on the fabric edge or selvedge, such as for instance the severance of the weft thread, can be performed independently of whether the weft thread and the selvedge-laying or tucking-in needle already are in alignment with over the transfer or threading nozzle. The weft thread can be previously fixed or clamped by the retention nozzle so that the weft thread can be, for instance after severance, maintained under tension and can be guided or maintained in position over the transfer or threading nozzle and in front of the selvedge laying or tucking-in needle.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 2 shows an associated detail in section;

FIG. 3 is an elevational view taken in partial section along the line III—III in FIG. 2;

FIGS. 5 and 6 show respective views corresponding to the FIGS. 4 and 2 with the components in another position;

FIGS. 8 and 9 illustrate yet later positions corresponding to FIGS. 7 and 6.

DETAILED DESCRIPTION OF THE PREFERRED EMBODIMENTS

Figure 1:
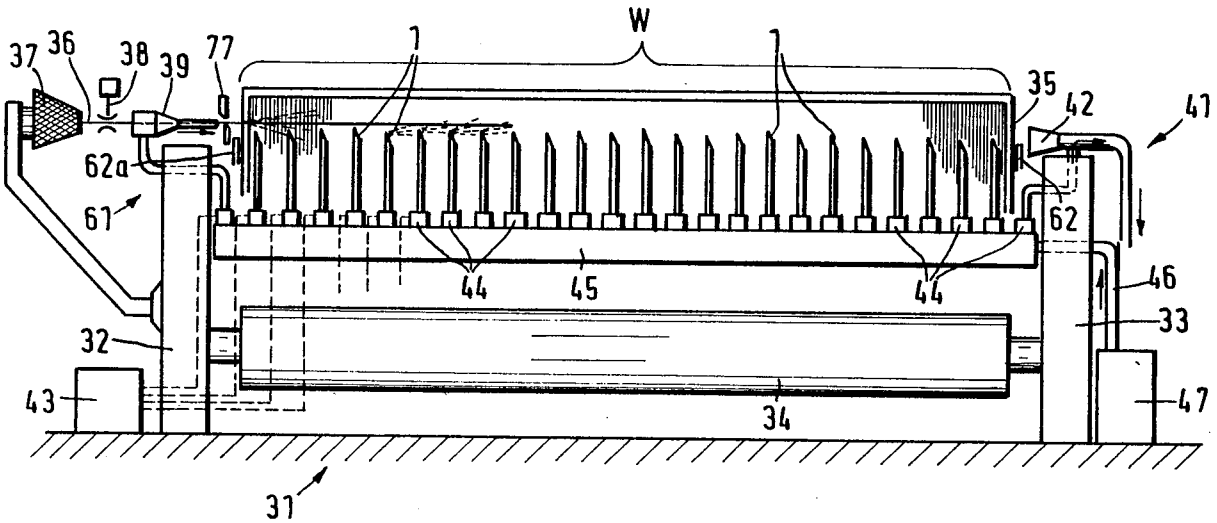
FIG. 1 schematically shows a pneumatic or air jet weaving machine seen from the woven fabric side.

Describing now the drawings, it is to be understood that, to simplify the showing thereof, only enough of the structure of the weaving machine has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a weaving machine 31 containing two machine end frames or cheek plates 32 and 33. A breast beam or fabric roll 34 and a weaving reed 35 are arranged between the end frames 32 and 33. The weft thread 36 is withdrawn or unwound from a stationary weft thread supply roll or cone 37, conducted through a weft thread tensioning device or brake 38 and blown into the weaving shed 65 by a main weft thread insertion nozzle 39 situated outside the weaving shed 65 having a weaving width W. Auxiliary nozzles 1 are distributed over the weaving width W and protrude into the weaving shed 65 during weft thread insertion. A suction nozzle 42 is arranged at the catch side 41.

The nozzles 39, 1 and 42 are, for instance, connected through tubes 101 and 102 or other suitable means for blowing air to an air distribution tube or manifold 45 by means of valves 44 controlled by an electronic control device 43. The air distribution tube or manifold 45 is supplied with air from any suitable air source, such as a compressed air reservoir or container 47, by an air supply line or conduit 46. The reservoir or container 47 is maintained under pressure by a not particularly shown air compressor.

An air nozzle, such as an air or blower nozzle 62*a* communicating with the means 102 for blowing directed upwardly in FIGS. 1 to 3, is arranged at the shot or weft insertion side 61 and is mounted upon a carriage or carrier 64 oscillating in the direction of the double-headed arrow 63. A further such air or blower nozzle 62 is arranged at the catch or weft receiving side 41 on the oscillatable carriage or carrier 64. The carriage or carrier 64 also contains a holding or retention nozzle 85 communicating with the means 101 for blowing. While the transfer or threading nozzle 62 for transferring the weft thread 36 blows upwardly in FIG. 2 (cf. arrow 86), the retention nozzle 85 blows downwardly in the opposite direction according to the arrow 87. The jet of air or other suitable fluid from the transfer or threading nozzle 62 arrives in a catch or exhaust channel 88 while the analogous jet from the retention nozzle 85 arrives in a catch or exhaust channel 89.

The weaving shed 65 into which the weft thread 36 is inserted is formed by the upper shed warp threads 66 and the lower shed warp threads 67. A number of edge or selvedge warp threads 68 fix or hold the weft thread ends 36*a*.

Figure 4:
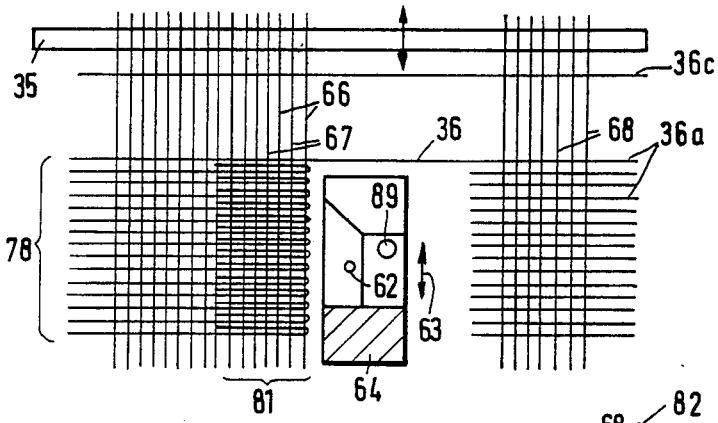
FIG. 4 is an associated plan view.
Figure 5:
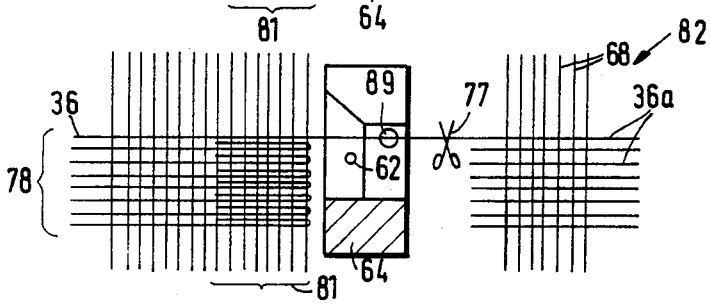

During the insertion of a given weft thread 36*c*, as shown in the upper portion of FIG. 4, the carriage or carrier 64 with the nozzles 62 and 85 is moved out of the forward inoperative motion-reversing position remote from the reed 35 as shown in FIG. 4 into a middle or intermediate position closer to the reed 35 shown in FIG. 5. During this operation, a selvedge-laying or tucking-in needle 72 is pivoted about the pivot point 71 shown in FIG. 2. The selvedge-laying or tucking-in needle 72 is pivoted in counter-clockwise direction as seen in FIG. 2 (cf. arrow 90) and arrives in a middle or intermediate position 72*a* shown in FIG. 6 and corresponding to FIG. 5. The tip or point 73 of the selvedge-laying or tucking-in needle 72 contains an eyelet 74 whose diameter is greater than the diameter of the transfer or threading nozzle 62. Now retention nozzle 85 is supplied with air and then the weft thread 36 is severed by a suitable shear or cutter 77. The weft thread end 36*d* is thereby blown into the catch or exhaust channel 89 according to FIG. 6, whereby the weft thread 36 is maintained under tension.

Figure 7:
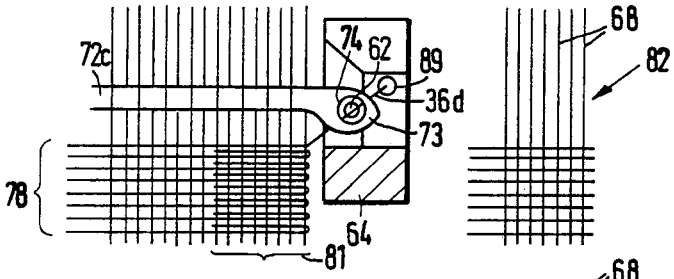
FIG. 7 illustrates a later position corresponding to FIG. 5.

During the further motion of the components, the carriage or carrier 64 arrives in the position according to FIG. 7 and the selvedge-laying or tucking in needle 72 arrives in the position 72*c* according to FIGS. 7 and 9 in which its eyelet 74 lies over or is aligned with the transfer or threading nozzle 62. Then the transfer or threading nozzle 62 is made operative by, for instance, supplying it with blower air and subsequently the retention nozzle 85 is deactivated. The weft thread end 36*d* is thereby drawn out of the catch or exhaust channel 89 and conducted into the catch or exhaust channel 88 according to FIG. 9. The weft thread end 36*d* is blown through the eyelet 74 and thereby transferred to the selvedge-laying or tucking-in needle 72.

Figure 8:
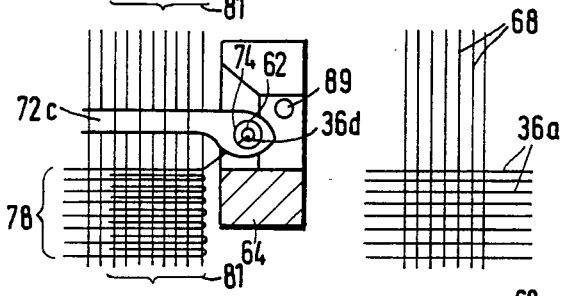
Figure 10:
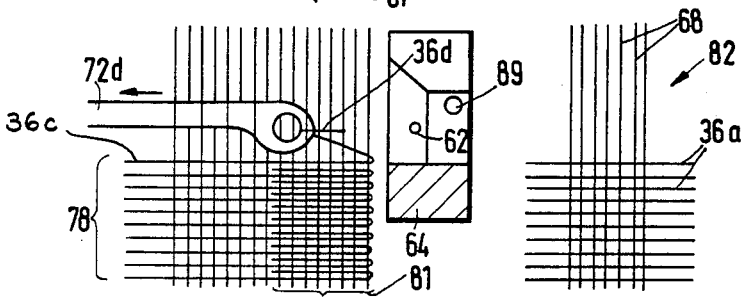
FIG. 10 shows a final position of the components corresponding to FIG. 8.

Subsequently the selvedge-laying or tucking-in needle 72 is moved to the left as seen in FIG. 10, so that the weft thread end 36*d* is reinserted or laid back, i.e. tucked, into the weaving shed 65 while the selvedge-laying or tucking-in needle 72 travels through the position 72*d*. The selvedge-laying or tucking-in needle 72 is thus withdrawn from the weaving shed 65. The blower air in the transfer or threading nozzle 62 is interrupted. The carriage or carrier 64 with the transfer or threading nozzle 62 is subsequently moved out of the rearward reversing position (operative position according to FIGS. 7, 8 and 10) again and into the forward reversal position (idle position) according to FIG. 4.

During this motion, the shed 65 is closed by not particularly shown weaving harnesses or equivalent structure and fixes or clamps the weft thread end 36*d*. Simultaneously, the reed 35 is pivoted to the right in FIG. 3 which beats-up the weft thread end 36*d* together with the corresponding weft thread 36*c* against the fell or edge 79 of the woven fabric 78.

The false selvedge 82 can now be removed and is incrementally drawn off. The weaving machine is ready for the insertion of a weft thread subsequent to the previously inserted weft thread 36*c*. A laid-in or tucked in listing or selvedge 81 is formed on the fabric or cloth 78 and forms the fabric edge or border thereof.

In a modified embodiment of the invention the nozzles 62 and 85 are arranged in reversed positions, i.e. the transfer or threading nozzle 62 is arranged above the weft thread 36 as seen in FIG. 2 while the retention nozzle 85 is arranged below the weft thread. Then the transfer or threading nozzle 62 blows air in the direction of the arrow 87 and the retention nozzle 85 in the direction of the arrow 86. The nozzles 62 and 85 can also blow air from one and the same side of the weft thread 36. One or both of the nozzles 62 and 85 can, for instance, also be supplied with water.

In yet another embodiment, the nozzles 62 and 85 are arranged immediately above one another and therefore have the same axis, i.e. they are aligned. Initially the retention nozzle 85 blows air toward the transfer or threading nozzle 62 which blows the weft thread end 36*d* into the transfer or threading nozzle 62 which serves temporarily as a catch channel. Subsequently, operation is reversed and the transfer or threading nozzle 62 blows air toward the retention nozzle 85 which blows the weft thread 36*d* out of the transfer or threading nozzle 62 serving as a catch channel and through the eyelet 74 of the selvedge-laying or tucking-in needle 72 into the retention nozzle 85 now serving in its turn as a catch channel. If desired, one of the nozzles 62 and 85 can be operated with a water or hydraulic jet and the other with a pneumatic or air jet.

While there are shown and described present preferred embodiments of the invention, it is to be distinctly understood that the invention is not limited thereto, but may be otherwise variously embodied and practiced within the scope of the following claims.

Accordingly, I claim:

1. In a weaving machine, comprising:

a weft thread supply cone which remains outside a weaving shed during weft insertion;

weft threads being unwound from said weft thread supply cone during weft insertion;

a selvedge-tucking needle for tucking in successive ends of weft threads which lie outside the weaving shed subsequently to the weft thread being picked;

a threading nozzle separate from said selvedge-tucking needle for transferring said weft thread ends of said weft threads to said selvedge-tucking needle, the improvement which comprises:

a retention nozzle for acting upon said weft thread previous to activation of said threading nozzle for retaining said weft thread end before transfer thereof to said selvedge-tucking needle.

2. The improvement as defined in claim 1, wherein:

said threading nozzle is oriented toward said weft thread in a first predetermined direction;

said retention nozzle being oriented towards said weft thread in a second predetermined direction; and said first and second predetermined directions being of opposite sense.

3. The improvement as defined in claim 1, further including:

means for blowing a predetermined medium into said threading nozzle and into said retention nozzle;

a first channel for said predetermined medium being provided opposite said threading nozzle and beyond said weft thread; and a second catch channel for said predetermined medium being provided opposite said retention nozzle and beyond said weft thread.

4. The improvement as defined in claim 1, further including:

valve means governing said retention nozzle; and control means controlling said valve means such that said retention nozzle is supplied with blower air before severance of said weft thread and until said threading nozzle becomes operative.

5. The improvement as defined in claim 1, further including:

to-and-fro movable carrier movable between an idle position and an operative position;

said retention nozzle and said threading nozzle being conjointly mounted on said to-and-fro movable carrier; and said retention nozzle and said threading nozzle being brought into operative association with said selvedge-tucking needle by said to-and-fro movable carrier during transfer of the weft thread end of a weft thread.

6. The improvement as defined in claim 5, wherein:

said retention nozzle comprises a first orifice;

said threading nozzle comprising a second orifice;

said retention nozzle and said threading nozzle being situated at said to-and-fro movable carrier such that said first and second orifices are in mutually staggered relationship; and said mutually staggered relationship being such that when said to-and-fro movable carrier moves from said idle position to said operative position said first orifice confronts said successive ends of weft threads and such that when said to-and-fro movable carrier is in said operative position said second orifice also confronts said successive ends of weft threads.

7. In a weaving machine, wherein weft threads are unwound from a weft thread supply cone which remains outside a weaving shed during weft thread insertion; a threading nozzle threading successive ends of said weft threads extending beyond said weaving shed into a selvedge-tucking needle; and said selvedge-tucking needle tucking said threaded successive ends of said threads into said weaving shed subsequent to said weft thread insertion, the improvement which comprises:

an oscillatable carrier for said threading nozzle;

a retention nozzle arranged on said oscillatable carrier;

said selvedge-tucking needle being separate from said threading nozzle;

said oscillating carrier having a forward operating position and a rearward idle position;

said retention nozzle confronting said successive ends of said inserted weft threads when said oscillatable carrier passes from said idle position to said operative position; and said threading nozzle confronting said successive ends of said weft threads and said selvedge-tucking needle simultaneously when said oscillatable carrier is in said operative position.

8. The improvement as defined in claim 7, further including;

a pressurized air source;

means for blowing air through said retention nozzle and said threading nozzle;

control means for said means for blowing air;

said control means being coordinated with said oscillatable carrier such that said retention nozzle is in operative communication with said pressurized air source when said oscillatable carrier moves from said idle position to said operative position and such that when said threading nozzle is in operative communication with said pressurized air source when said oscillatable carrier is in said operative position and such that said retention nozzle is out of operative communication with said pressurized air source when said threading nozzle is in operative communication with said pressurized air source.

9. The improvement as defined in claim 7, wherein:

said selvedge-tucking needle is provided with weft thread engagement means; and said oscillatable carrier being coordinated with said selvedge-tucking needle such that said weft thread engagement means confronts said threading nozzle when said oscillatable carrier is in said operative position.

10. The improvement as defined in claim 7, wherein:

said retention nozzle and said threading nozzle are mounted on said oscillatable carrier in close mutual proximity.

11. A method of tucking weft thread ends into a selvedge of a fabric which is being woven at a weaving machine, comprising the steps of:

unwinding weft threads from a weft thread supply cone which remains outside a weaving shed during weft thread insertion;

moving an oscillatable carrier supporting a retention nozzle and a threading nozzle toward a forward operative position where said retention nozzle confronts successive ends of inserted weft threads extending beyond said weaving shed;

supplying air to said retention nozzle for retaining said successive ends of inserted weft thread;

operating a shear device to sever said successive ends of retained weft threads from a false selvedge;

moving said oscillatable carrier into said operative position such that said threading nozzle also confronts said successive ends of severed weft threads;

advancing an oscillatable selvedge-tucking needle through said weaving shed such that a weft thread engagement means of said oscillatable selvedge-tucking needle confronts said threading nozzle and therefore also said successive ends of weft threads;

said oscillatable selvedge-tucking needle being separate from said threading nozzle;

supplying air to said oscillatable selvedge-tucking needle to thread said successive ends of weft threads into said weft thread engagement means of said oscillatable selvedge-tucking needle;

interrupting the supply of air to said retention nozzle; and retracting said oscillatable selvedge-tucking needle through said weaving shed to tuck said successive ends of threaded weft threads into said weaving shed to form the selvedge of the fabric being woven.

12. The method as defined in claim 11, wherein:

said step of supplying air to said retention nozzle entrains said successive ends of severed weft threads into a first catch channel arranged in said oscillatable carrier and confronting said retention nozzle;

said step of supplying air to said threading nozzle entrains said successive ends of weft threads through said weft thread engagement means of said selvedge-tucking needle and into a second catch channel arranged in said oscillatable carrier and confronting said threading nozzle; and said step of retracting said selvedge-tucking needle entrains said successive ends of threaded weft threads into said weaving shed.

* * * * *

UNITED STATES PATENT AND TRADEMARK OFFICE

CERTIFICATE OF CORRECTION

PATENT NO. : 4,552,187

DATED : November 12, 1985

INVENTOR(S) : Gotthilf Bertsch and Josef Braun

It is certified that error appears in the above—identified patent and that said Letters Patent is hereby corrected as shown below:

Column 5, line 20, after "first" please insert --catch--

Signed and Sealed this

*Twenty-eighth* Day of *January 1986*

[SEAL]

*Attest:*

DONALD J. QUIGG

*Attesting Officer*

*Commissioner of Patents and Trademarks*